US011839344B2

(12) United States Patent
Mantes et al.

(10) Patent No.: US 11,839,344 B2
(45) Date of Patent: Dec. 12, 2023

(54) SOUND REDUCING VACUUM CLEANER

(71) Applicant: MILWAUKEE ELECTRIC TOOL CORPORATION, Brookfield, WI (US)

(72) Inventors: Jonathan M. Mantes, Franklin, WI (US); Anthony R. Sleck, Lisbon, WI (US); Fraizier Reiland, Milwaukee, WI (US); Zachary Self, Nashotah, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 518 days.

(21) Appl. No.: 16/554,849

(22) Filed: Aug. 29, 2019

(65) Prior Publication Data

US 2020/0069126 A1 Mar. 5, 2020

Related U.S. Application Data

(60) Provisional application No. 62/724,852, filed on Aug. 30, 2018.

(51) Int. Cl.
*A47L 9/00* (2006.01)
*A47L 5/36* (2006.01)
(Continued)

(52) U.S. Cl.
CPC ..... *A47L 9/0081* (2013.01); *A47L 9/009* (2013.01); *A47L 9/10* (2013.01); *A47L 9/248* (2013.01); *A47L 5/365* (2013.01)

(58) Field of Classification Search
CPC ..... A47L 15/365; A47L 19/0081; A47L 5/365
See application file for complete search history.

(56) References Cited

U.S. PATENT DOCUMENTS 2,863,524 A 12/1958 Buda
4,222,145 A 9/1980 Lowder
(Continued)

FOREIGN PATENT DOCUMENTS

CN 102711577 A 10/2012
CN 104068789 A 10/2014
(Continued)

OTHER PUBLICATIONS

International Search Report and Written Opinion for Application No. PCT/US2019/048712 dated Dec. 4, 2019 (11 pages).
(Continued)

*Primary Examiner* — Bryan R Muller
(74) *Attorney, Agent, or Firm* — Michael Best & Friedrich LLP

(57) ABSTRACT

A vacuum cleaner including a suction inlet that provides entrance of a suction airflow, a suction source, a diffuser, a blower port, a duct, and a removable cap. The diffuser is in fluid communication with the suction source for diffusing the suction airflow and the diffuser includes a circumferential opening that surrounds the suction source such that the suction airflow travels through the opening into the diffuser. The duct is located downstream of the blower port with respect to the direction of the suction airflow and the duct includes an outlet. The cap is removably coupled to the blower port such that at least a portion of the suction airflow exhausts through the blower port when the cap is removed, and when the cap is coupled to the blower port the suction airflow is travels through the duct and exhausts through the outlet.

23 Claims, 7 Drawing Sheets

(51) Int. Cl.
*A47L 9/24* (2006.01)
*A47L 9/10* (2006.01)

(56) References Cited

U.S. PATENT DOCUMENTS

| | | | | |
|---|---|---|---|---|
| 4,654,926 | A | 4/1987 | McCambridge | |
| 4,845,793 | A | 7/1989 | Meyer | |
| 4,970,753 | A * | 11/1990 | Herron, Jr. | A47L 9/0081 15/327.2 |
| 7,143,469 | B2 | 12/2006 | Moine et al. | |
| 8,074,321 | B2 | 12/2011 | Fry et al. | |
| 8,176,596 | B2 | 5/2012 | Conrad | |
| 8,667,640 | B2 | 3/2014 | Conrad | |
| 8,689,983 | B1 | 4/2014 | Ripley | |
| 8,973,196 | B2 | 3/2015 | Tomasiak | |
| 9,854,955 | B2 | 1/2018 | Richter | |
| 10,791,889 | B2 | 10/2020 | Conrad et al. | |
| 10,888,207 | B2 * | 1/2021 | Tomasiak | A47L 9/22 |
| 2005/0257340 | A1 | 11/2005 | Parrott | |
| 2007/0113369 | A1 | 5/2007 | Cochran et al. | |
| 2010/0071151 | A1 * | 3/2010 | Crevling, Jr | A47L 7/0019 15/326 |
| 2016/0235266 | A1 | 8/2016 | Tomasiak | |
| 2017/0303754 | A1 | 10/2017 | Conrad et al. | |
| 2018/0078104 | A1 | 3/2018 | Register et al. | |
| 2020/0178740 | A1 * | 6/2020 | Keller | A47L 9/22 |

FOREIGN PATENT DOCUMENTS

| | | | |
|---|---|---|---|
| CN | 107837038 | A1 | 3/2018 |
| CN | 107981778 | A | 5/2018 |
| CN | 207545020 | U | 6/2018 |
| DE | 2227935 | A1 | 12/1973 |
| DE | 4004177 | A1 | 8/1991 |
| EP | 1520502 | A2 | 4/2005 |
| EP | 3223672 | A1 | 10/2017 |
| EP | 3295853 | A1 | 3/2018 |
| JP | H08-303394 | A | 11/1996 |
| JP | 2012-217782 | A | 11/2012 |
| KR | 10-1606890 | B1 | 3/2016 |
| WO | 9835600 | A1 | 8/1998 |
| WO | 2008070974 | A1 | 6/2008 |
| WO | 2012107964 | A1 | 8/2012 |
| WO | 2016054457 | A1 | 4/2016 |

OTHER PUBLICATIONS

Extended European Search Report for Application No. 19855475.0 dated May 3, 2022 (8 pages).
Extended European Search Report for Application No. 19814131.9 dated Jun. 17, 2022 (8 pages).
Chinese Patent Office Action for Application No. 201980036038.5 dated Nov. 18, 2021 (25 pages including statement of relevance and English translation).
Chinese Patent Office Action for Application No. 201980036038.5 dated Apr. 20, 2022 (19 pages including statement of relevance and English translation).

* cited by examiner

SOUND REDUCING VACUUM CLEANER

CROSS-REFERENCE TO RELATED APPLICATIONS

This application claims priority to U.S. Provisional Patent Application No. 62/724,852 filed on Aug. 30, 2018, the entire contents of which incorporated herein by reference.

BACKGROUND

The present invention relates to vacuum cleaners and more particularly to a vacuum cleaner including a vacuum and blower mode of operation.

Vacuum cleaners may include an inlet for bringing air into the vacuum cleaner. The air may travel through the vacuum cleaner and exhaust out of a blower port or a second outlet port. The vacuum cleaner may include sound reducing material for reducing the sound of the air within the vacuum cleaner.

SUMMARY

The invention provides, in one embodiment, a vacuum cleaner including a suction inlet that provides entrance of a suction airflow, a suction source, a diffuser, a blower port, a duct, and a removable cap. The suction source is operable to generate the suction airflow through the suction inlet. The diffuser is in fluid communication with the suction source for diffusing the suction airflow and the diffuser includes a circumferential opening that surrounds the suction source such that the suction airflow travels through the opening into the diffuser. The blower port is in fluid communication with the diffuser to exhaust the suction airflow. The duct is located downstream of the blower port with respect to the direction of the suction airflow and the duct includes an outlet. The cap is removably coupled to the blower port such that at least a portion of the suction airflow exhausts through the blower port when the cap is removed, and when the cap is coupled to the blower port the suction airflow is travels through the duct and exhausts through the outlet.

In another embodiment, the invention provides a vacuum cleaner including a suction inlet that provides entrance of a suction airflow, a diffuser, a suction source, a blower port, a duct, and a removable cap. The diffuser is in fluid communication with the suction inlet. The suction source is operable to generate the suction airflow through the suction inlet and the diffuser. The blower port is in fluid communication with the diffuser to exhaust the suction airflow. The duct is in fluid communication with the blower port and includes sound reducing baffles for disturbing the suction airflow within the duct. The sound reducing baffles include sound reducing material. The duct further includes an outlet for exhausting the suction airflow. The cap is removably coupled to the blower port such that at least a portion of the suction airflow exhausts through the blower port when the cap is removed, and when the cap is coupled to the blower port the suction airflow is travels through the duct and exhausts through the outlet.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
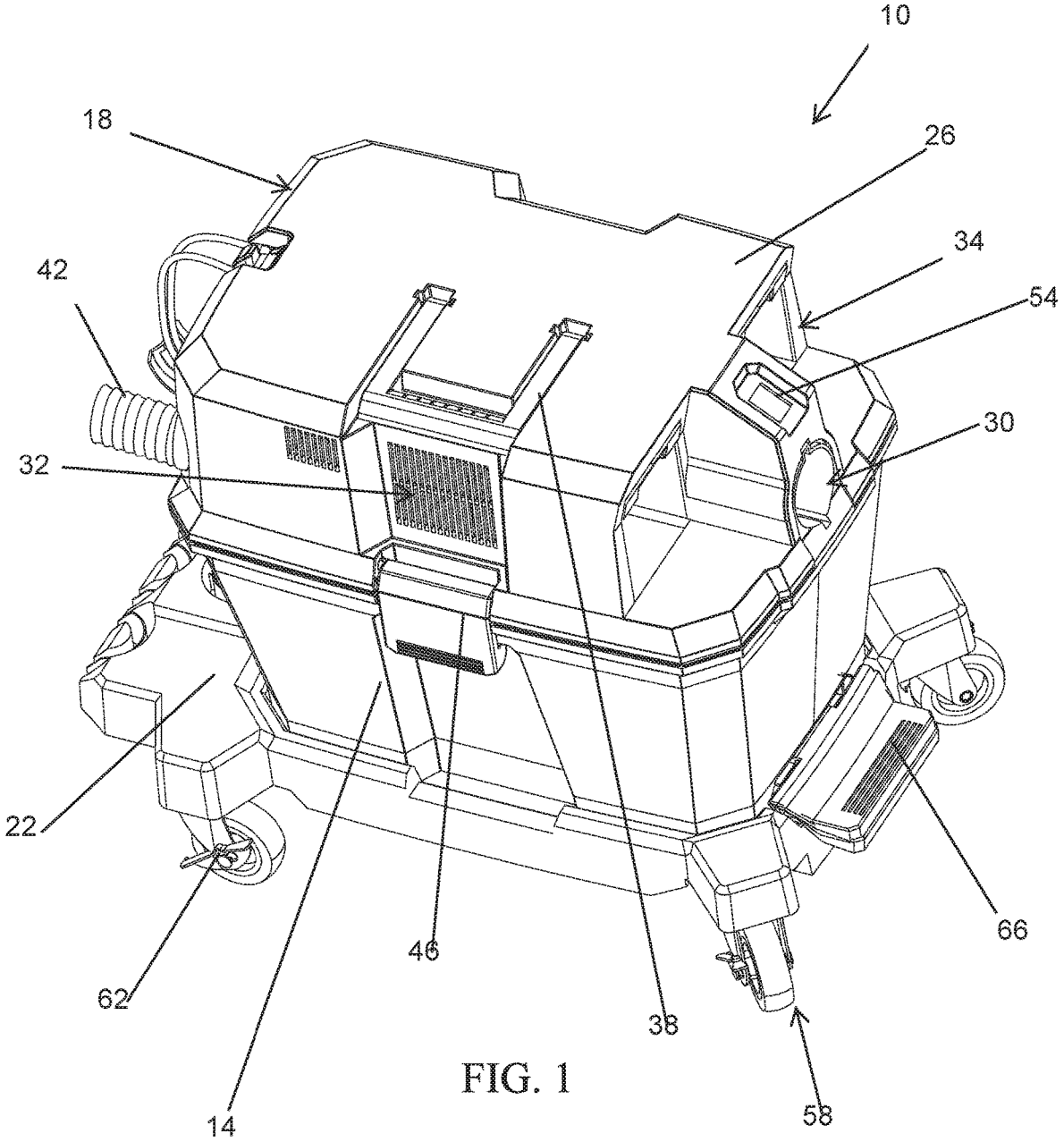
FIG. 1 is a perspective view of a vacuum cleaner in accordance with one embodiment.

FIG. 1 illustrates a vacuum cleaner 10 according to an embodiment of the present disclosure. The vacuum 10 includes a collector 14, a power head 18, a base 22, and a housing 26. The power head 18 includes a suction inlet 30, an exhaust vent 32, multiple battery bays 34, a handle 38, a detachable hose 42, a latching assembly 46, a suction source 50, and a switch 54. The latching assembly 46 may be actuated to selectively couple the collector 14 to the power head 18. As described in greater detail below, the suction source 50 is powered by a battery attached to the vacuum 10 in the battery bays 34 and operates to generate a suction airflow within the vacuum 10. The switch 54 may be actuated to energize the suction source 50 such that when the switch 54 is in an ON position, power is provided from the battery to power the suction source 50. When the switch 54 is in an OFF position, power is not provided to the suction source 50. In another embodiment, the suction source 50 directly receives power from a cord connected to an external power source.

With further reference to FIG. 1, the base 22 includes caster wheels 58, where one or more of the caster wheels 58 include a caster brake 62 for braking the caster wheels 58 and preventing movement of the base 22. The base 22 further includes a foot pedal 66 to selectively detach the base 22 from the collector 14. In another embodiment, the collector 14 may be formed with the base 22 as one piece. In yet another embodiment, the base 22 may include non-slip feet or other supporting members to keep the base in a stable orientation.

Figure 2:
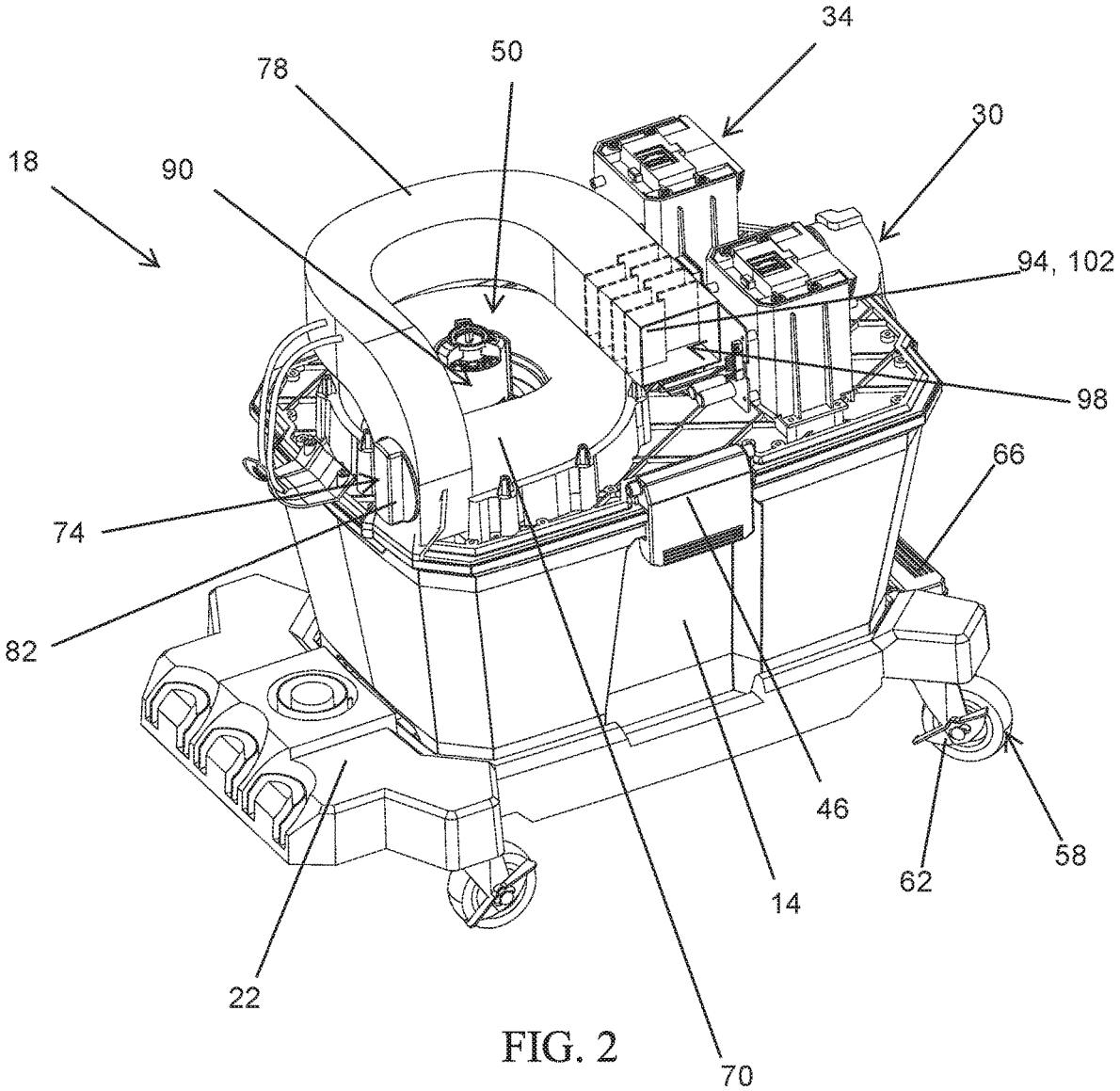
FIG. 2 is a perspective view of the vacuum cleaner of FIG. 1 with a lid removed.
Figure 3:
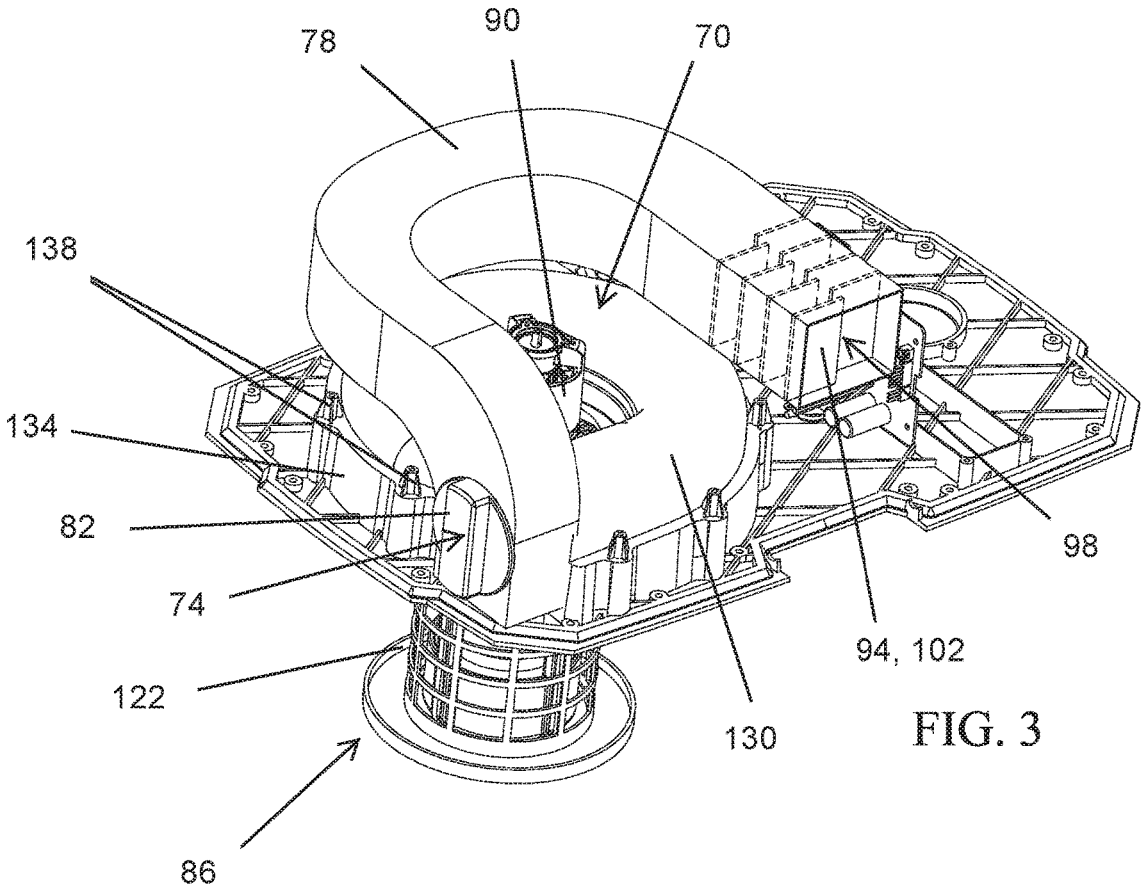
FIG. 3 is a perspective view of a duct apparatus of the vacuum cleaner of FIG. 1.

As illustrated in FIGS. 2 and 3, the power head 18 further includes a diffuser 70, a blower port 74, a duct 78, and a cap 82. The suction source 50 includes a filter assembly 86, a fan 88, and a motor 90. The duct 78 is fluidly connected to the diffuser 70 and the blower port 70 for housing the suction airflow. The duct 78 includes sound reducing baffles 94 and an outlet 98 for exhausting the suction airflow. The baffles 94 are protrusions that may extend inwardly from walls within the duct 78. The outlet 98 of the duct 78 aligns with the exhaust vent 32 of the power head 18. In the illustrated embodiment, the sound reducing baffles include sound reducing material 102 for increasing the sound reduction of the airflow as it travel through the dust 78, and the exhaust vent 32 houses sound reducing material 102. In another embodiment, the duct 78 and vent 32 include other sound reducing material 102 such as foam, cloth, or other noise reducing materials of the like.

Figure 4:
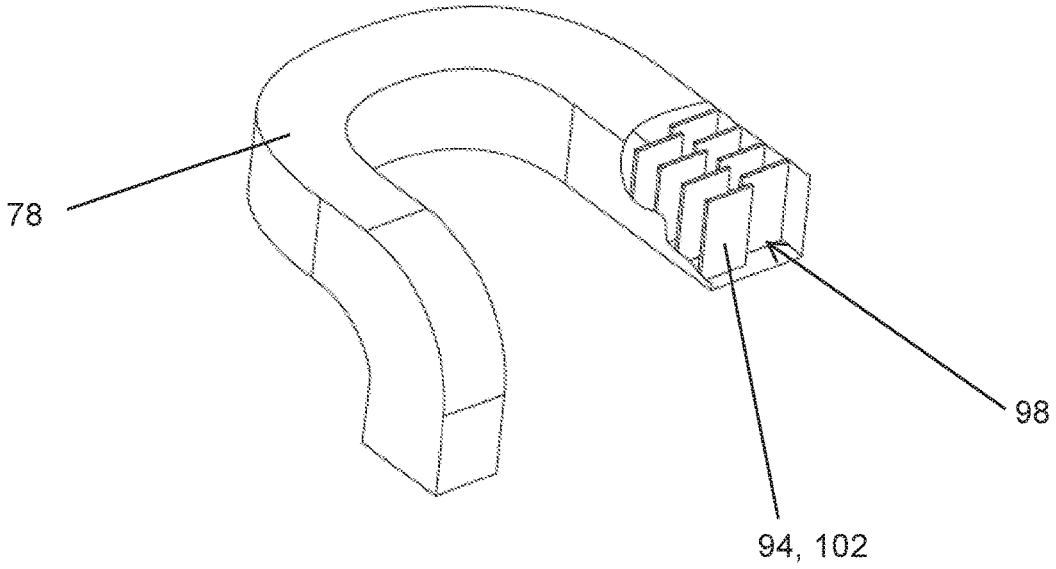
FIG. 4 is an isolated perspective view of the duct of FIG. 3.

In the illustrated embodiment of FIGS. 2-4, the duct 78 has a rectangular cross-section. In some embodiments, the duct 78 has any shaped cross-section ideal for exhausting the suction airflow and for supporting sound reducing material 102 within the duct 78. With continued reference to FIGS. 2 and 3, the cap 82 may be removably coupled to the blower port 74. When the cap 82 is coupled to or covers the blower port 74, the suction airflow bypasses the blower port 74 and flows through the duct 78 and out of the outlet 98. When the cap 82 is removed from the blower port 74, the suction airflow exhausts through the blower port 74 and through the outlet 98. In the illustrated embodiment, the detachable hose 42 may be connected to the blower port 74 for receiving the suction airflow and exhausting the suction airflow out of the hose 42 such that when the hose 42 is attached to the blower port 74, the hose 42 extends past the blower port 74 and into the diffuser 70 for receiving generally all of the suction airflow so that all of the suction airflow is discharged through the house 42 and the hose 42 can be used as blower.

In the illustrated embodiment, when the vacuum 10 is operating and the cap 82 is coupled to the blower port 74 the noise level is reduced and there is relatively little reduction in suction performance or efficiency of the vacuum cleaner 10. In some embodiments, the noise level is reduced to less than 66 dBa when the vacuum 10 is operating and the cap 82 is coupled to the blower port 74. In some embodiments, there is no more than 10 percent reduction in suction airflow when the vacuum 10 is operating and the cap 82 is coupled to the blower port 74.

The function of the suction source 50 will now be described in more detail with reference to FIGS. 5 and 6. The motor 90 includes a shaft 106, electrical connections 110, and a motor housing 114. The electrical connections 110 are disposed on the motor housing 114 for receiving power to power the motor 90. The motor 90 drives the shaft 106 and the shaft 106 may be coupled to the fan 88 such that rotation of the shaft 106 corresponds to rotation of the fan 88 for generating the suction airflow.

Figure 5:
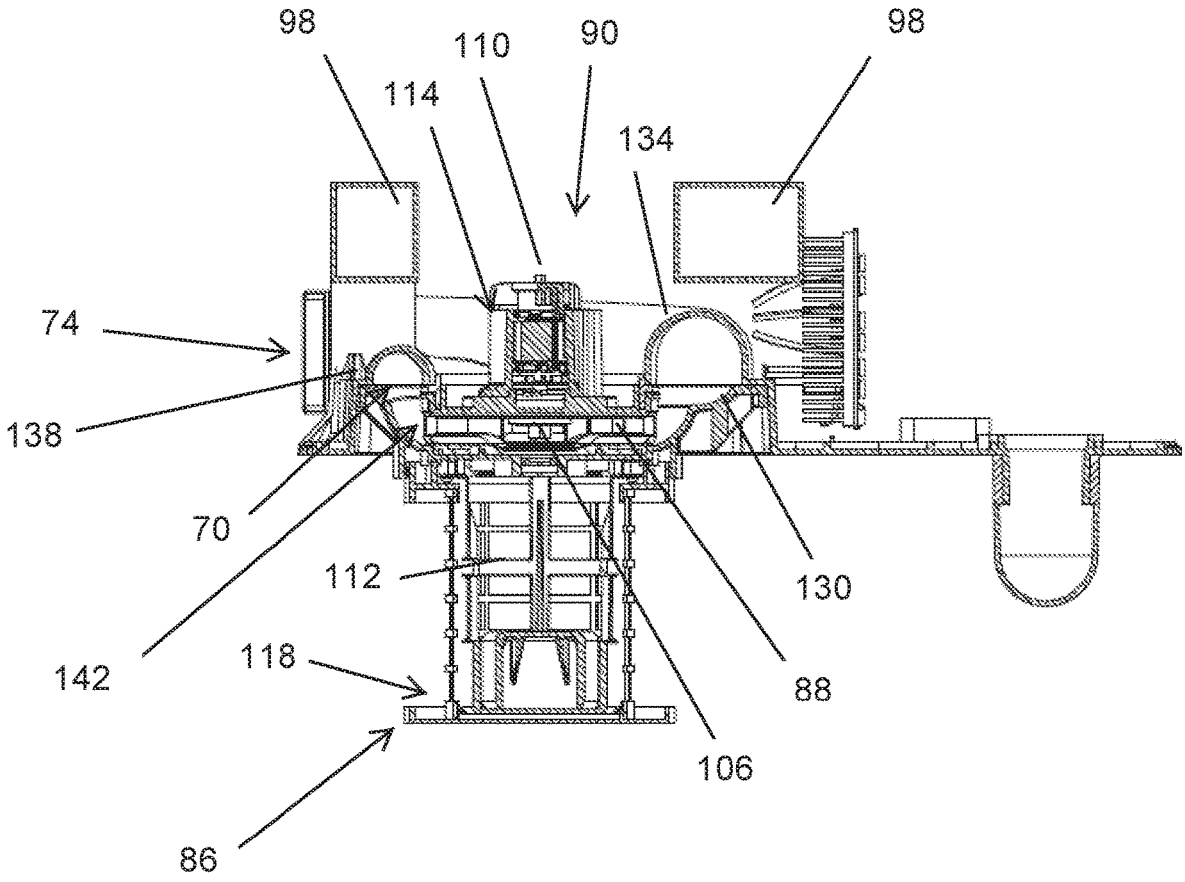
FIG. 5 is a cross-sectional view of the vacuum cleaner of FIG. 3 through section line A.
Figure 6:
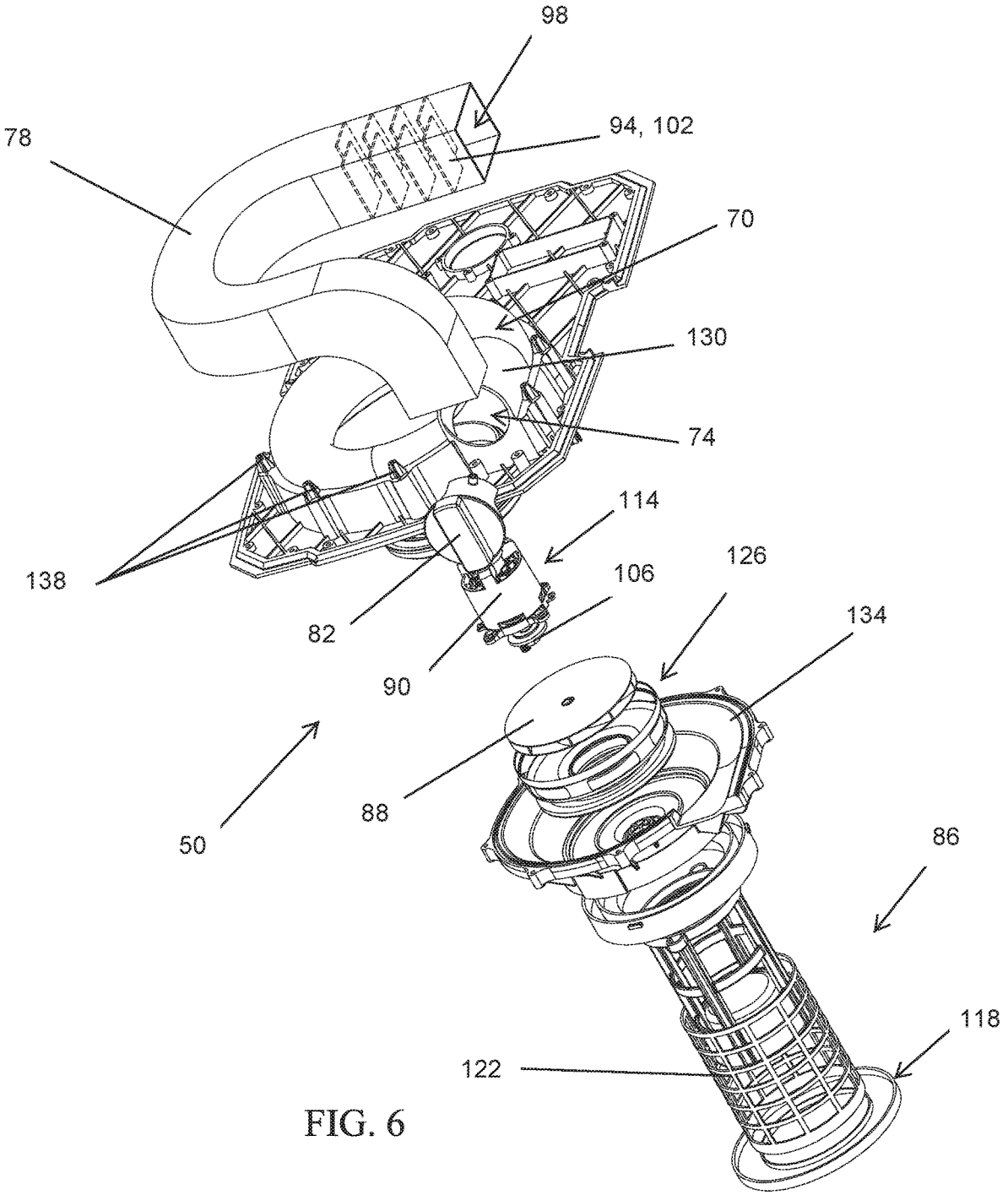
FIG. 6 is an exploded perspective view of the vacuum cleaner of FIG. 3

With continued reference to FIGS. 5 and 6, the filter assembly 86 includes a filter housing 118 that supports a filter 122 on the filter housing 118. In the illustrated embodiment, the vacuum cleaner 10 is configured such that the suction airflow generated by the suction source is received by the collector 14 through the suction inlet 30 and is sucked through the filter assembly 86. In some embodiments, the vacuum cleaner 10 may be used to pull a debris laden suction airflow in through the inlet 30 and deposit debris separated from the suction airflow into the collector 14. Some debris that is not separated from the airflow may be caught by the filter 122.

In the illustrated embodiment, the suction source 50 further includes a shroud assembly 126. In some embodiments, collected debris that passes through the filter 122 and contacts a surface over time may create abrasions on such a surface. As illustrated in FIG. 5, the shroud assembly 126 rotates about the shaft 106 and operates to resist the abrasions on the motor 90, the fan 88 and the other components included in the suction source 50.

With continued reference to FIGS. 5 and 6, the diffuser 70 will be explained in detail. The diffuser 70 houses the suction airflow and is in fluid communication with the suction source 50. In the illustrated embodiment, the diffuser 70 includes a first casting 130 and a second casting 134 coupled to each other at a plurality of connection points 138 such that the diffuser 70 has a scroll or spiral shape. In another embodiment, the diffuser 70 is formed of one piece.

In the illustrated embodiment, the diffuser 70 includes an opening 142, and the opening 142 circumferentially surrounds the suction source 50 such that suction airflow entering the suction source 50 may pass through the diffuser 70 through the opening 142. The diffuser 70 has a relatively semi-circular cross-section with a corresponding cross-sectional area. As illustrated in FIG. 5, the cross-sectional area of the first casting 130 increases or decreases depending on where the cross-section is being taken. The suction airflow entering the diffuser 70 is evenly distributed within the diffuser 70 due to the shape of the first and second casing 130,134. The suction airflow entering the diffuser 70 through the opening 142 is directed toward the blower port 74 through the largest cross-sectional diameter of the diffuser 70.

Figure 7:
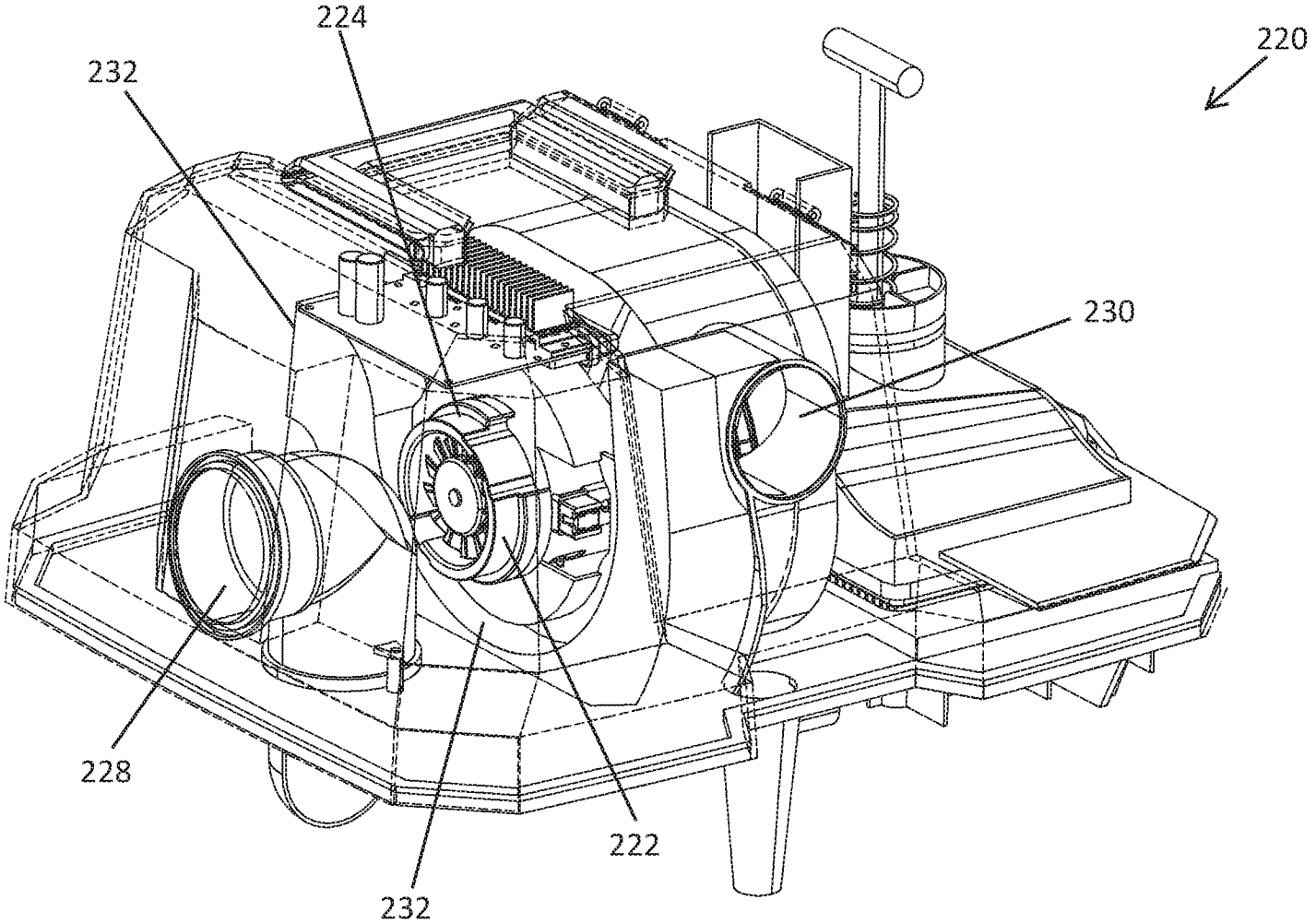
FIG. 7 is a perspective view of a vacuum cleaner in accordance with a second embodiment.
Figure 8:
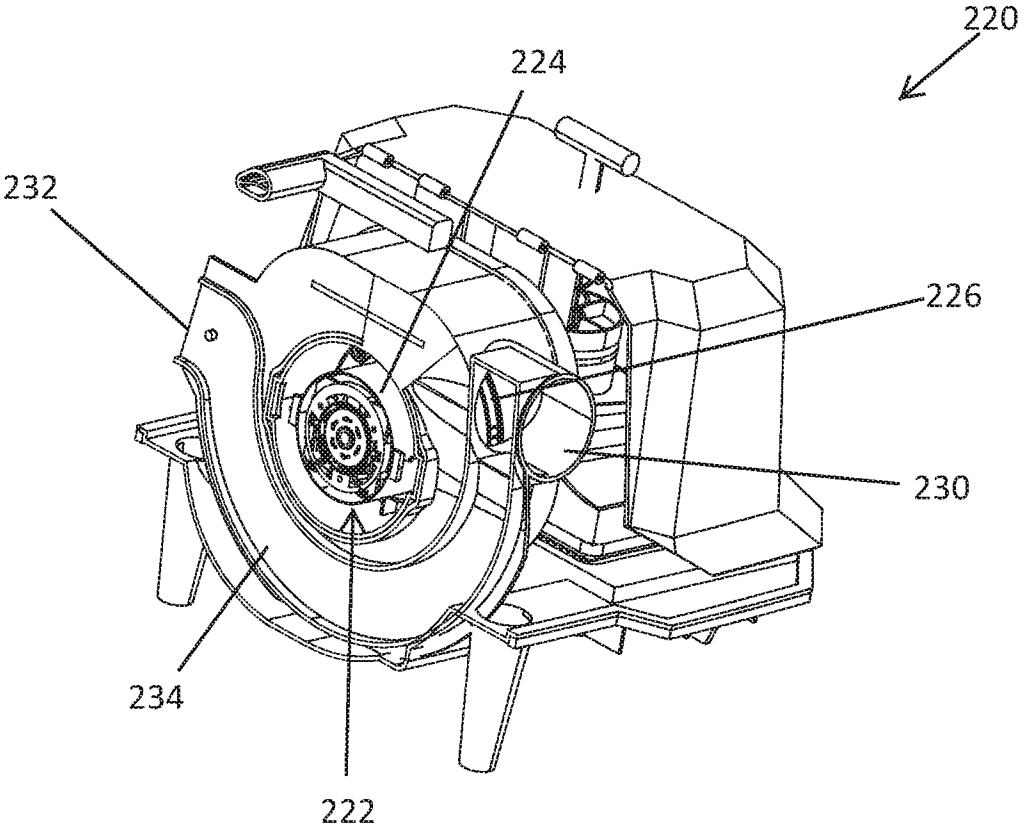
FIG. 8 is a cross-sectional perspective view of the vacuum cleaner of FIG. 7 through section line B.

FIGS. 7 and 8 illustrate a powerhead 220 that can be used with the canister or collector 14 of FIG. 1 in another embodiment. The powerhead 220 includes a suction source 222 that includes a motor 224 and a fan 226. The illustrated powerhead 220 further includes an inlet 228. The suction source 222 is operable to generate a suction airflow through the inlet 228 to draw debris and the airflow into the canister 14. The powerhead 220 further includes a first outlet 230 and a second outlet 232 for exhausting the suction airflow from the suction source 222. The first outlet 230 is adjacent the fan 226 and upstream from the second outlet 232. A duct 234 extends from the first outlet 230 to the second outlet 232. The duct 234 may include baffles, foam, and the like that reduce the noise or the sound level of the exhaust airflow traveling through the duct 234 and the second outlet 232. Louvers or the like may extend across the second outlet 232 to direct the suction airflow that exits through the second outlet 232.

The powerhead 220 includes a cap, similar to the cap 82 of FIG. 3. In the illustrated embodiment, the inlet 228 and the first outlet 230 are circular such that the first outlet 230 can receive the suction hose that attaches to the inlet 228. That is, the suction hose can be disconnected from the inlet 228 and attached to the first outlet 230. The suction hose may be attached to the first outlet 230 so that the vacuum cleaner can be used as a blower. The cap is circular so that the cap can cover the first outlet 230. The cap may be tethered or attached to the powerhead 220 and the cap can also be attached to and cover the inlet 228. The user may use the cap 238 to cover the inlet when the vacuum is not in use, particularly when the vacuum is being transported, so that debris in the canister does not undesirably exit the canister through the inlet 228.

In operation, the powerhead 220 can be used in a first mode. In the first mode, the cap is removed and the cap does not cover the first outlet 230. In the first mode, the suction airflow is exhausted from the fan 226 and exits the powerhead 220 through the first outlet 230. In this first mode, the powerhead 220 can be used as a blower, as discussed above, and/or the powerhead 220 can also be used as a vacuum drawing in air and debris through the inlet 228. The cap is attached to the first outlet 230 to cover the first outlet 230 to use the vacuum in a second mode or quiet mode. With the cap covering the first outlet 230, the exhausted suction airflow does not exit through the first outlet 230 and the airflow is directed through the duct 234, through the body of the powerhead 220, and toward the second outlet 232. The duct 234 dampens or reduces the noise/sound level of the exhausted suction airflow. The exhaust suction airflow then exits the powerhead 220 through the second outlet 232. In some embodiment, the noise level is reduced to less than 66 dBa in the second or quiet mode. In some embodiments, there is no more than a 10 percent reduction is suction airflow when used in the second or quiet mode. Therefore, the powerhead 220 can be used by the user in a first mode when the vacuum is used as a blower and/or when noise level is not a concern. The powerhead 220 can be used in the second or quiet mode when noise reduction is desired but yet there is relatively little reduction is suction performance or efficiency. In other embodiments, the powerhead may include a valve or valves to direct the exhaust airflow to either the first outlet 230 or the second outlet 232.

Although the invention has been described in detail with reference to certain preferred embodiments, variations and modifications exist within the scope and spirit of one or more independent aspects of the invention as described.

What is claimed is:

1. A vacuum cleaner comprising:

a suction inlet providing entrance of a suction airflow;

a suction source, the suction source operable to generate the suction airflow through the suction inlet;

a diffuser in fluid communication with the suction source for diffusing the suction airflow, the diffuser including a circumferential opening surrounding the suction source such that the suction airflow travels through the opening into the diffuser;

a blower port in fluid communication with the diffuser for exhausting the suction airflow, the blower port positioned on one side of the opening;

a duct downstream of the blower port along the suction airflow, the duct including an outlet positioned on another side of the opening, such that the opening is positioned horizontally between the horizontal positions of the blower port and the outlet, and the duct is a generally U-shaped duct extending between the blower port and the outlet, the entirety of the generally U-shaped duct located at a height above the blower port; and a cap removably coupled to the blower port such that at least a portion of the suction airflow exhausts through the blower port when the cap is removed and when the cap is coupled to the blower port the suction airflow travels through the duct and exhausts through the outlet.

2. The vacuum cleaner of claim 1, further comprising a powerhead including the suction source, the power head removably coupled to a collector, and the collector receiving the suction airflow.

3. The vacuum cleaner of claim 2, wherein the suction source includes a filter for filtering the suction airflow.

4. The vacuum cleaner of claim 3, wherein the suction airflow from the suction inlet passes into the collector before the suction airflow reaches the filter.

5. The vacuum cleaner of claim 4, wherein the power head includes a detachable hose optionally attached to the blower port such that the suction airflow is exhausted out of the hose.

6. The vacuum cleaner of claim 5, wherein when the hose is attached to the blower port, a portion of the hose extends toward the diffuser such that all of the suction airflow is exhausted out of the hose.

7. The vacuum cleaner of claim 1, wherein the diffuser defines a semi-circular cross-section having a cross-sectional area, and the cross-sectional area increases or decreases depending on the location within the diffuser.

8. The vacuum cleaner of claim 7, wherein the duct has a rectangular cross-section.

9. The vacuum cleaner of claim 1, wherein the duct includes sound reducing baffles for disturbing the suction airflow within the duct.

10. The vacuum cleaner of claim 9, wherein the sound reducing baffles include sound reducing material.

11. A vacuum cleaner comprising:

a suction inlet providing entrance of a suction airflow;

a diffuser in fluid communication with the suction inlet;

a suction source, the suction source operable to generate the suction airflow through the suction inlet and diffuser;

a blower port in fluid communication with the diffuser for exhausting the suction airflow, the blower port positioned on one side of the suction source;

a duct in fluid communication with the blower port, the duct including sound reducing baffles for disturbing the suction airflow within the duct, the sound reducing baffles including sound reducing material, an outlet for exhausting the suction airflow, the outlet positioned on another side of the suction source, such that the suction source is positioned horizontally between the horizontal positions of the blower port and the outlet, and the duct is a generally U-shaped duct extending between the blower port and the outlet, the entirety of the generally U-shaped duct located at a height above the blower port; and a cap removably coupled to the blower port such that at least a portion of the suction airflow exhausts through the blower port on the one side of the suction source when the cap is removed and when the cap is coupled to the blower port the suction airflow travels downstream through the duct and exhausts through the outlet on the another side of the suction source.

12. The vacuum cleaner of claim 11, further comprising a powerhead including the suction source, the power head removably coupled to a collector, and the collector receiving the suction airflow.

13. The vacuum cleaner of claim 12, wherein the powerhead includes a filter for filtering the suction airflow.

14. The vacuum cleaner of claim 13, wherein the suction airflow from the suction inlet passes into the collector before the suction airflow reaches the filter.

15. The vacuum cleaner of claim 14, wherein the power head includes a detachable hose optionally attached to the blower port such that the suction airflow is exhausted out of the hose.

16. The vacuum cleaner of claim 11, wherein the diffuser circles around the suction source and is partially open to the suction source.

17. The vacuum cleaner of claim 11, wherein the duct has a rectangular cross-section.

18. The vacuum cleaner of claim 17, wherein the baffles are protrusions extending inwardly from inner walls within the duct.

19. The vacuum cleaner of claim 18, wherein the outlet is a vent housing sound reducing material on one or more of the sound reducing baffles.

20. A vacuum cleaner comprising:

a suction inlet providing entrance of a suction airflow;

a suction source, the suction source operable to generate the suction airflow through the suction inlet;

a diffuser in fluid communication with the suction source for diffusing the suction airflow, the diffuser including a circumferential opening surrounding the suction source such that the suction airflow travels through the opening into the diffuser;

a blower port in fluid communication with the diffuser for exhausting the suction airflow in a first direction;

a duct downstream of the blower port along the suction airflow, the duct including an outlet for exhausting the suction airflow in a second direction that is substantially orthogonal to the first direction, and the duct is a generally U-shaped duct extending between the blower port and the outlet, the entirety of the generally U-shaped duct located at a height above the blower port; and a cap removably coupled to the blower port to selectively divert the suction airflow through the duct and through the outlet, wherein the duct is configured to reduce noise generated by the vacuum cleaner such that the vacuum cleaner is operable in a quiet mode while the cap is coupled to the blower port.

21. The vacuum cleaner of claim 1, wherein the duct is the sole duct extending from the blower port.

22. The vacuum cleaner of claim 1, further comprising a plurality of sound reducing baffles extending inwardly within the duct from a first wall of the duct and from a second wall of the duct opposite the first wall.

23. The vacuum cleaner of claim 22, wherein the plurality of sound reducing baffles are spaced apart from one another along a length of the duct adjacent to the outlet of the duct.

* * * * *